US006011939A

United States Patent [19]

Martin

[11] Patent Number: 6,011,939

[45] Date of Patent: Jan. 4, 2000

[54] SENSING PRINT MEDIA SIZE TO TEMPERATURE CONTROL A MULTI-HEATING ELEMENT FIXING DEVICE

[75] Inventor: Michael J. Martin, Boise, Id.

[73] Assignee: Hewlett-Packard Company, Palo Alto, Calif.

[21] Appl. No.: 09/126,628

[22] Filed: Jul. 30, 1998

[51] Int. Cl.[7] ..... G03G 15/20

[52] U.S. Cl. ..... 399/69

[58] Field of Search ..... 399/45, 67, 69, 399/70

[56] References Cited

U.S. PATENT DOCUMENTS

| | | | |
|---|---|---|---|
| 4,585,325 | 4/1986 | Euler | 399/69 |
| 5,049,906 | 9/1991 | Kobayashi et al. | 399/67 X |
| 5,081,493 | 1/1992 | Miyasaka | 399/69 |
| 5,220,389 | 6/1993 | Kishimoto et al. | 399/69 |
| 5,303,015 | 4/1994 | Sato | 399/69 |
| 5,568,229 | 10/1996 | Szlucho | 399/67 X |

*Primary Examiner*—Fred L. Braun
*Attorney, Agent, or Firm*—Gregg W. Wisdom

[57] ABSTRACT

A fixing device control system controls multiple heating elements included in the fuser so that the duty cycle of the power applied to the multiple heating elements results in an optimal temperature profile over the length of the fuser. Multiple thermistors are used in a feedback control circuit to regulate the temperature profile of the fuser. A formatter uses print data from a host to generate data defining the size and location of a printing area on the print media. Using the data defining the size and location of the printing area, the formatter generates a command to send to a controller. The controller applies power to the multiple heating elements in order to generate the fuser temperature profile corresponding to the command. In a first embodiment of the fixing device control system, the formatter generates the command by using the data defining the size and location of the printing area to access information stored in a table. In a second embodiment of the fixing device control system, the formatter computes the command from the data defining the printing area.

19 Claims, 6 Drawing Sheets

SENSING PRINT MEDIA SIZE TO TEMPERATURE CONTROL A MULTI-HEATING ELEMENT FIXING DEVICE

FIELD OF THE INVENTION

This invention relates to the fixing of toner to print media in an electrophotographic printing system. More particularly, this invention relates to the control of a multi-heating element fixing device in an electrophotographic printing system.

BACKGROUND OF THE INVENTION

The use of heating elements to fix toner to print media in electrophotographic printing systems is well known. Prior art technology employs one or more resistive heating elements enclosed in a glass bulb which is inserted into a cylinder formed of a thermally conductive material such as aluminum. The cylinder is coated with a material, such as TEFLON, to reduce toner adhesion to the surface. This embodiment of a fixing device is typically referred to as a fuser. The heat generated by the resistive heating element is transferred to the exterior surface of the fuser through radiation, convection and thermal conduction through the wall of the cylinder. Frequently, the glass bulb is filled with a halogen gas to allow the heating element to be operated at a higher temperature. Another prior art fixing device implementation, known as an instant on fuser, includes a strip of material forming a resistive heating element. The resistive heating element can be formed on the ceramic substrate through a thick film deposition process. The resistive heating element is covered by a coating of glass. The coating of glass permits low friction rotation of a film sleeve over the glass as well as providing electrical insulation. Typically, in an instant on fuser, the resistive heating element is fabricated on the ceramic substrate with the electrical connections at one end of the long axis of the fuser. Multiple resistive heating elements may be used in the instant on fuser.

A significant technical problem encountered in the use of fixing devices is the maintenance of a uniform temperature across the portion of the surface of the fixing device contacting the print media. Generally, a single temperature sensor is located near one end of the surface of the fixing device outside the path the print media follows as it passes over the fixing device. Alternative implementations use a temperature sensor located within the print media path. The temperature sensor is part of a circuit which controls the flow of power to heating elements within the fixing device in an attempt to create a uniform temperature profile across the surface of the fixing device. The thermal loading of the print media on the surface of the fixing device results in a decrease in the surface temperature of the fixing device in those locations on the surface in contact with the print media. Because the temperature sensor provides a measure of the temperature on the surface of the fixing device outside of the print media path in an area which is not thermally loaded, an assumption about the surface temperature offset between this area and an area within the print media path must be made to provide effective control of the fixing device surface temperature profile over the width of the print media. As the width of the print media varies, the value of this temperature offset can change substantially as a result of differences in the thermal loading.

Another alternative implementation uses a thermistor located in the print media path. In this implementation, the circuit will compensate for the thermal loading by the print media path. However, portions of the fixing device located outside of the print media path are not thermally loaded and as a result will be heated above the target temperature. High temperature areas on the fixing device can result in warping of the pressure roller contacting the surface of the fixing device, thereby reducing the life of the fixing device.

In addition to the reliability problems created by non-uniform temperatures, the non-uniformities can result in degraded fixing quality. This occurs from the development of locations across the width of the print media for which the fixing device surface temperature is too high or too low for optimum fusing of the toner. Too low of a fusing temperature can result in toner which is not properly fixed to the print media. Too high of a fusing temperature can result in melted toner adhering to the surface of the fixing device, offsetting the toner from the correct location on the print media.

With fixing devices having multiple heating elements, information about the size of the print media on which printing will be performed is used to control the application of power to the multiple heating elements in the fixing device. In the past, sensors have been included in the print engine to detect the size of the print media on which printing will be performed. These have been placed in the paper path to detect the width of the print media moving through the paper path. Based upon the detected width of the print media, the controller applies power to one or more of the heating elements in an attempt to obtain the desired temperature profile across the length of the fixing device.

Multiple heating elements distributed along the length of a fixing device have been employed in an attempt to provide a uniform surface temperature profile for print media having a variety of widths. The electrical power to each of the heating elements in the fixing device is controlled by a separate control circuit. By controlling the duty cycle of the line power applied to each of the heating elements based upon the print media width detected by the printer, a surface temperature profile with greater uniformity for a given media width can be created. However, part of the difficulty involved in controlling the heating elements is providing data to the controller about the width of the print media on which printing will be performed. For standard sized print media, this information is determined from the tray in which the print media is located. For custom sized print media, sensors in the print media path have been used for detecting the print media width. The use of sensors in the print media path to detect a large variety of print media widths is prohibitively expensive. A need exists for a way in which to determine the width of print media without sensors in the print media path and use this information to control the application of power to the fixing device.

SUMMARY OF THE INVENTION

Accordingly, in an electrophotographic printing system for printing on print media a method for controlling the application of power to a fixing device has been developed. The electrophotographic printing system includes a formatter to generate data defining a printing areas on the print media. The electrophotographic printing system further includes a controller operatively coupled to the formatter. The fixing device is operatively coupled to the controller. The fixing device includes a plurality of heating elements. The method for controlling the application of power to the plurality of heating elements includes the step of sending a command from the formatter to the controller specifying to which of the plurality of heating elements to apply power. The method further includes the step of controlling the application of power to the plurality of heating elements, using the controller, according to the command received from the formatter.

An electrophotographic printing system includes a system for controlling a fixing device having a plurality of heating elements. The system for controlling the fixing device includes a formatter to generate data defining a printing area from print data and to generate a command from the data defining the printing area. The system for controlling the fixing device further includes a controller operatively coupled to the formatter to receive the command, with the controller operatively coupled to the fixing device to control the application of power to the plurality of heating elements in response to the command.

An electrophotographic printing system includes a formatter to generate data defining a printing area from print data and to generate a command from the data defining the printing area. The electrophotographic printing system further includes a controller operatively coupled to the formatter to receive the command. The electrophotographic printing system further includes a fixing device having a plurality of heating elements. The controller operatively couples to the fixing device to control the application of power to the plurality of heating elements in response to the command.

DESCRIPTION OF THE DRAWINGS

A more thorough understanding of the invention may be had from the consideration of the following detailed description taken in conjunction with the accompanying drawings in which.

DETAILED DESCRIPTION OF THE DRAWINGS

The present invention is not limited to the specific exemplary embodiments illustrated herein. Although the embodiments of the fixing device control system will be discussed in the context of a monochrome electrophotographic printer, one of ordinary skill in the art will recognize by understanding this specification that the fixing device control system has applicability in both color and monochrome electrophotographic image forming systems. Furthermore, although the embodiments of the fixing device control system will be discussed in the context of a monochrome electrophotographic printer, one of ordinary skill in the art will recognize by understanding this specification that other types of electrophotographic printing systems such as electrophotographic copiers could use the fixing device control system.

Figure 1:
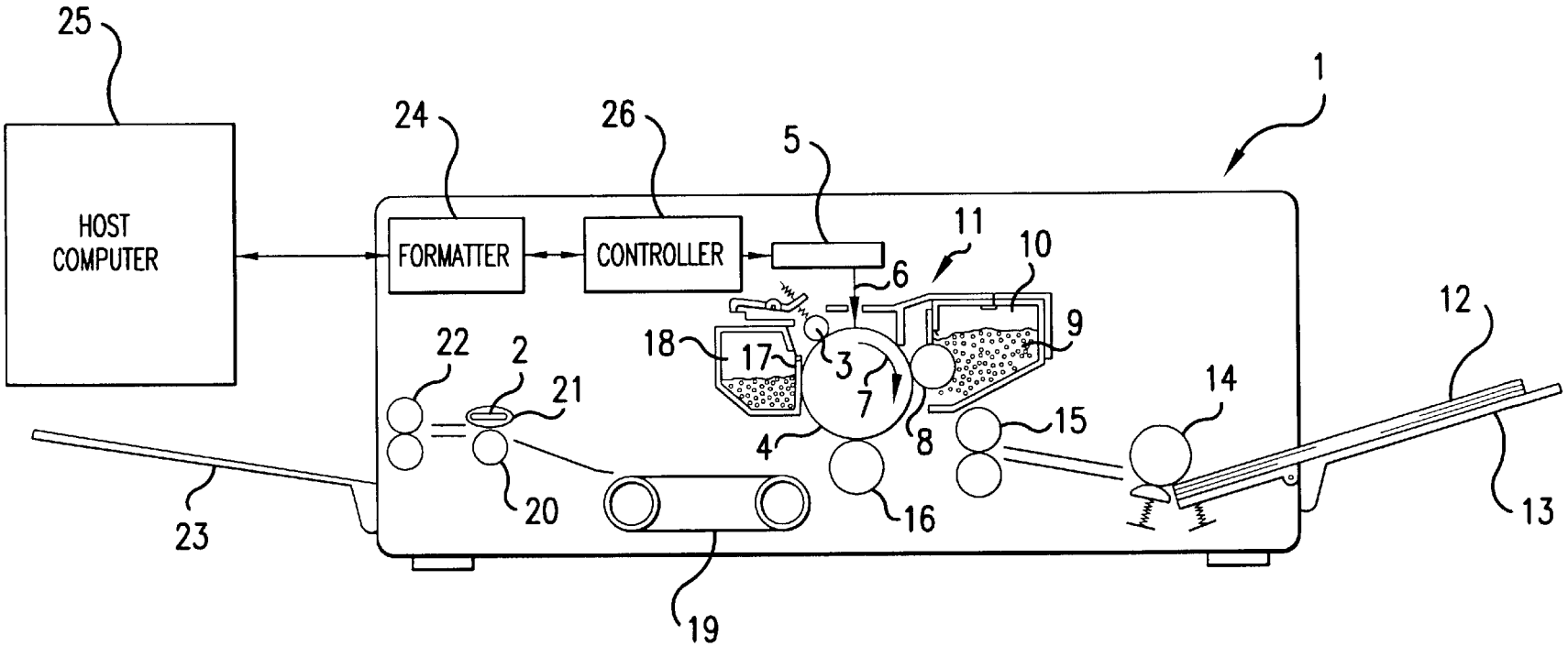
FIG. 1 is a simplified cross section of an electrophotographic printer including an embodiment of the fixing device control system.

Referring to FIG. 1, shown is a simplified cross sectional view of an electrophotographic printer 1 containing an embodiment of the fixing device control system used to control a fixing device, such as fuser 2. Fuser 2 is an instant on type fuser having multiple heating elements. It should be recognized that although the disclosed embodiment of the fixing device control system is discussed in the context of an electrophotographic printer 1 using an instant on type fuser having multiple heating elements, it could also be applied to other types fixing devices, such as a halogen bulb type fuser having multiple halogen bulbs.

Charge roller 3 is used to charge the surface of photoconductor drum 4 to a predetermined voltage. A laser diode (not shown) inside laser scanner 5 emits a laser beam 6 which is pulsed on and off as it is swept across the surface of photoconductor drum 4 to selectively discharge the surface of the photoconductor drum 4. Photoconductor drum 4 rotates in the clockwise direction as shown by the arrow 7. Developer roller 8 is used to develop the latent electrostatic image residing on the surface of photoconductor drum 4 after the surface voltage of the photoconductor drum 4 has been selectively discharged. Toner 9 which is stored in the toner reservoir 10 of electrophotographic print cartridge 11 moves from locations within the toner reservoir 10 to the developer roller 8. The magnet located within the developer roller 8 magnetically attracts the toner to the surface of the developer roller 8. As the developer roller 8 rotates in the counterclockwise direction, the toner on the surface of the developer roller 8, located opposite the areas on the surface of photoconductor drum 4 which are discharged, is moved across the gap between the surface of the photoconductor drum 4 and the surface of the developer roller 8 to develop the latent electrostatic image.

Print media 12 is loaded from paper tray 13 by pickup roller 14 into the paper path of the electrophotographic printer 1. Print media 12 moves through the drive rollers 15 so that the arrival of the leading edge of print media 12 below photoconductor drum 4 is synchronized with the rotation of the region on the surface of photoconductor drum 4 having a latent electrostatic image corresponding to the leading edge of print media 12. As the photoconductor drum 4 continues to rotate in the clockwise direction, the surface of the photoconductor drum 4, having toner adhered to it in the discharged areas, contacts the print media 12 which has been charged by transfer roller 16 so that it attracts the toner particles away from the surface of the photoconductor drum 4 and onto the surface of the print media 12. The transfer of toner particles from the surface of photoconductor drum 4 to the surface of the print media 12 does not occur with one hundred percent efficiency and therefore some toner particles remain on the surface of photoconductor drum 4. As photoconductor drum 4 continues to rotate, toner particles which remain adhered to its surface are removed by cleaning blade 17 and deposited in toner waste hopper 18.

As the print media 12 moves in the paper path past photoconductor drum 4, conveyer belt 19 delivers the print media 12 to fuser 2. Print media 12 passes between pressure roller 20 and the sleeve 21 surrounding fuser 2. Pressure roller 20 forces print media 12 against sleeve 21 deforming sleeve 21. Pressure roller 20 provides the drive force to rotate sleeve 21 around fuser 2 as pressure roller 20 rotates. At the fuser 2, heat is applied to print media 12 through the sleeve 21 so that the toner particles are fused to the surface of print media 12. Output rollers 22 push the print media 12 into the output tray 23 after it exits fuser 2.

Formatter 24 receives print data, such as a display list, vector graphics, or raster print data, from the print driver operating in conjunction with an application program in host computer 25. Formatter 24 converts this relatively high level print data into a stream of binary print data. Formatter 24 sends the stream of binary print data to controller 26. In addition, formatter 24 and controller 26 exchange data necessary for controlling the electrophotographic printing process. Controller 26 supplies the stream of binary print data to laser scanner 5. The binary print data stream sent to the laser diode in laser scanner 5 pulses the laser diode to create the latent electrostatic image on photoconductor drum 4. Included in the print data sent through the printer driver from the application operation in host computer 25, is data used by formatter 24 to determine the size of the area to be printed. This data includes information specifying the size and weight of the print media 12 on which printing will be performed.

In addition to providing the binary print data stream to laser scanner 5, controller 26 controls a high voltage power supply (not shown in FIG. 1) to supply voltages and currents to components used in the electrophotographic processes such as charge roller 3, developer roller 8, and transfer roller 16. Furthermore, controller 26 controls the drive motor (not shown in FIG. 1) that provides power to the printer gear train and controller 26 controls the various clutches and paper feed rollers necessary to move print media 12 through the print media path of electrophotographic printer 1. Further details on electrophotographic processes can be found in the text "The Physics and Technology of Xerographic Processes", by Edgar M. Williams, 1984, a Wiley-Interscience Publication of John Wiley & Sons, the disclosure of which is incorporated by reference herein.

The print data forming print jobs sent by host computer 25 to electrophotographic printer 1 could cover areas on the sheets of print media 12 ranging from a very small percentage of the total area available to all of the available printable area on the sheets of print media 12. For example, text may cover the entire available area on a sheet of print media 12, while an image may cover only a small section of the available area on a sheet of print media 12. Additionally, different sizes of print media 12 used in electrophotographic printer 1, will have different total areas available for printing. For example, a note card has a much smaller available printing area than a letter size sheet of print media 12. For both the case in which different size areas are to be printed on the same size print media 12 and the case in which different size sheets of print media 12 are used, wear on the components in the fixing device is reduced by controlling the application of power to the multiple heating elements to optimize the temperature profile across fuser 2 for fixing toner to print media 12. An optimal temperature profile is one in which fuser 2 provides sufficient heat for fixing toner across the width of print media 12 while keeping the areas of fuser 2 outside of the width of print media 12 at as low a temperature as possible.

As part of the formatting operation performed by formatter 24, formatter firmware generates data that defines the area, both its size and position, to be printed on the print media 12. Formatter 24 uses print data received from host computer 25 to generate data defining the printing area on print media 12. The generation of this data is affected by the size of the print media 12 on which printing will be performed as well as the area of the print media 12 which the print data will occupy. Toner may be transferred onto the print media 12 within this printing area. To reduce wear to pressure roller 20 resulting from the high temperature generated by fuser 2, the application of power to the heating elements included in fuser 2 is controlled to fix toner to the print media 12 within the printing area determined by firmware in formatter 24 while keeping the temperature of fuser 2 outside of the toner fixing region at as low a temperature as possible, consistent with maintaining an adequate temperature in the toner fixing region.

Consider the case in which printing is performed on print media 12 which has a width less than the width of fuser 2. Optimization of the temperature profile across fuser 2 is done to achieve an ideal temperature for fusing and to prevent areas on fuser 2 outside of the width of print media 12 from overheating. If power were applied to the heating element corresponding to the width of print media 12 and no power were applied to the heating element outside of the width of print media 12, an optimal temperature profile across fuser 2 would not be obtained. Because heat would be conducted away from the portion of fuser 2 in contact with print media 12, the desired temperature uniformity would not be achieved. However, by applying power to the heating element located outside of the width of print media 12, the loss of heat from the portion of fuser 2 in contact with print media 12 is reduced, thereby improving the uniformity of the temperature distribution of fuser 2. Additionally, by controlling the duty cycle of power applied to the heating element located outside the width of print media 12, excessive temperatures in this portion of the fuser are prevented, thereby reducing wear on pressure roller 20.

To control the multiple heating elements included within fuser 2 in this fashion, formatter 24 generates a command to send to controller 26. This command includes the data necessary to instruct controller 26 to control the application of power to the multiple heating elements to achieve the optimal temperature profile across fuser 2. Formatter 24 includes within its non-volatile memory, such as ROM, a table used to relate the size and location of the printing area determined by the formatter to the commands used to instruct controller 26 to apply power to the multiple heating elements of fuser 2 corresponding to the printing area. It should be recognized that the table could be stored in volatile memory that is loaded on the power up of electrophotographic printer 1.

The command generated by formatter 24 is sent to the controller 26. At the appropriate time, depending upon the time required for fuser 2 to reach the operating temperature, controller 26 applies power to the heating elements of fuser 2 corresponding to the command sent by formatter 24 (which in turn corresponds to the printing area defined by formatter 24). Multiple thermistors located across the print media path are used by controller 26 to regulate the temperature profile across fuser 2 at the level specified by the command sent from formatter 24. When print media 12 passes through fuser 2, only the areas of print media 12 onto which toner has been transferred are heated. By controlling the multiple heating elements of fuser 2 in this manner, the heat damage to pressure roller is reduced, thereby extending the life of this component.

Controlling the power applied to the multiple heating elements using commands generated by the formatter has a significant cost and reliability advantage over the use of a sensor located in the print media path to determine if print media 12 has a minimum width. The disclosed fixing device control system does not need to use sensors to determine the width of the print media, thereby avoiding the expense of the additional components needed for sensing print media width. Additionally, because the disclosed fixing device control system makes use of the existing hardware in the printer and does not require a print media path sensor and associated components, reliability is improved over systems to control the fixing device which use a print media path sensor.

The disclosed fixing device control system also provides an additional reliability advantage over a system to control the fixing device using a print media path sensor. Consider a system to control the fixing device which uses a sensor in the print media path to control the application of power to the multiple heating elements in the fuser. Assume this system uses three heating elements distributed along the width of the print media path with the middle heating element located at the center of the print media path. In this system, the print media sensor is located at one end of the middle heating element.

For print media having widths less than that required to activate the print media sensor, only the center heating element would have the power applied to reach the toner fixing temperature. For print media having widths greater than or equal to that required to activate the print media sensor, the power applied to all three heating elements would be that required to reach the toner fixing temperature. In this system, print media of only an incrementally greater width than that required to activate the sensor would result in the application of the power necessary to reach the toner fixing temperature to all three heating elements, even though print media of this particular width may (depending on the actual area for printing) only require the application of power sufficient to reach the toner fixing temperature to the middle heating element.

However, the disclosed fixing device control system would be able to optimally control the application of power to the multiple heating elements so that with the print media of the previous example, the power necessary to reach the toner fixing temperature would only be applied to the middle heating element, if the printing area would be covered by the middle heating element, thereby preventing unnecessary heating of pressure roller 20. The effect of the heating of pressure roller 20 upon reliability would be particularly severe if printing were performed on a large number of units of print media having a size as in the previous example.

Implementation of the fixing device control system in electrophotographic printer 1 requires that formatter 24 have the capability to generate the command for controller 26 based upon the printing area defined by formatter 24. This capability could be implemented using a microprocessor or micro-controller operating under the control of firmware which accesses the commands in the table based upon the printing areas defined by formatter 24. Alternatively, the capability to generate the command for controller 26 could be implemented with a dedicated logic circuit. The dedicated logic circuit could be designed which would generate the commands using the data defining the printing area. The dedicated logic circuit could be accomplished using a table which is accessed based upon an address computed from the data defining the printing area, or the dedicated logic circuit could generate the command directly from the data defining the printing area.

Controller 26 must have the capability to recognize the command sent by formatter 24 to control the fixing device. A microprocessor or micro-controller could be used to receive the command from formatter 24. Additionally, the microprocessor or micro-controller could be used to control electronic switches or mechanical relays that can connect power to the heating elements of the fixing device. Using controller 26 to selectively control the application of power through electronic switches to the multiple heating elements of fuser 2 is well known. However, in the prior art, controller 26 received the data to determine how to control the multiple heating elements from sensors in the print media path or in the print media trays. In the disclosed fixing device control system, the command used by controller 26 to selectively apply power to the multiple heating elements of fuser 2 is generated by formatter 24 using print data provided by host computer 25. This command is sent from formatter 24 to controller 26. Controller 26 uses this command to selectively apply power to the multiple heating elements of fuser 2.

Figure 2:
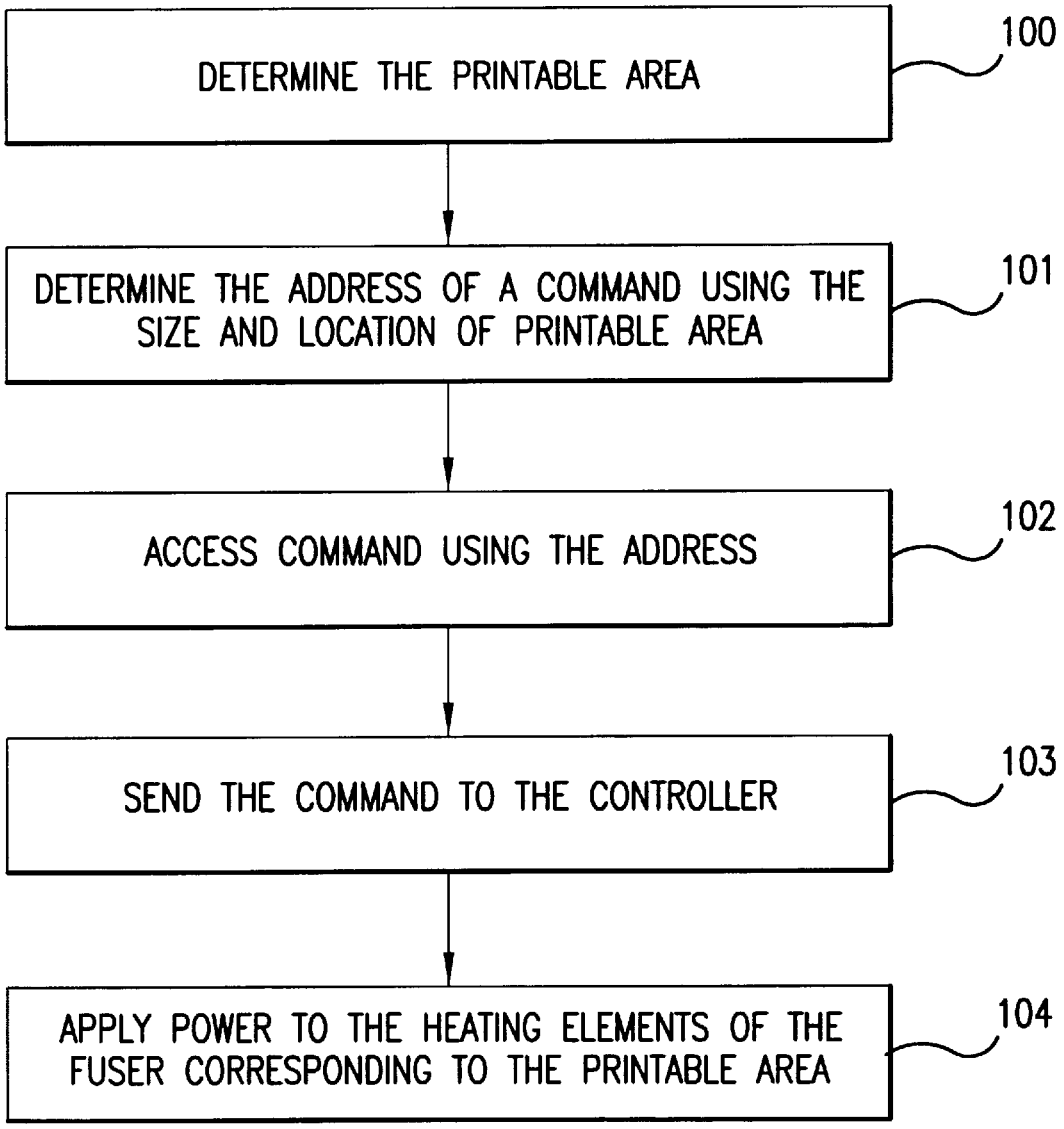
FIG. 2 shows a simplified flow chart of a first method for using the fixing device control system.

Shown in FIG. 2 is a high level flow chart of a method for using a first embodiment of the fixing device control system to control fuser 2 of electrophotographic printer 1. In first embodiment of the fixing device control system, formatter 24 generates commands to send to controller 26 for energizing the fuser 2 by accessing information stored in a table. Additionally in the first embodiment of the fixing device control system, firmware executed by a microprocessor in formatter 24 generates the commands. First the microprocessor in formatter 24 determines 100 the printing area on print media 12 using the print data from host computer 25. Next, the microprocessor in formatter 24 determines 101 the address of a command for controller 26 using the size and location of the printing area. Then, the microprocessor in formatter 24 accesses 102 the command using the address. Next, formatter 24 sends 103 the command to controller 26. Finally controller 26 applies 104 power to the heating elements of fuser 2 in order to obtain the desired temperature profile corresponding to the printing area defined by formatter 24.

Figure 3:
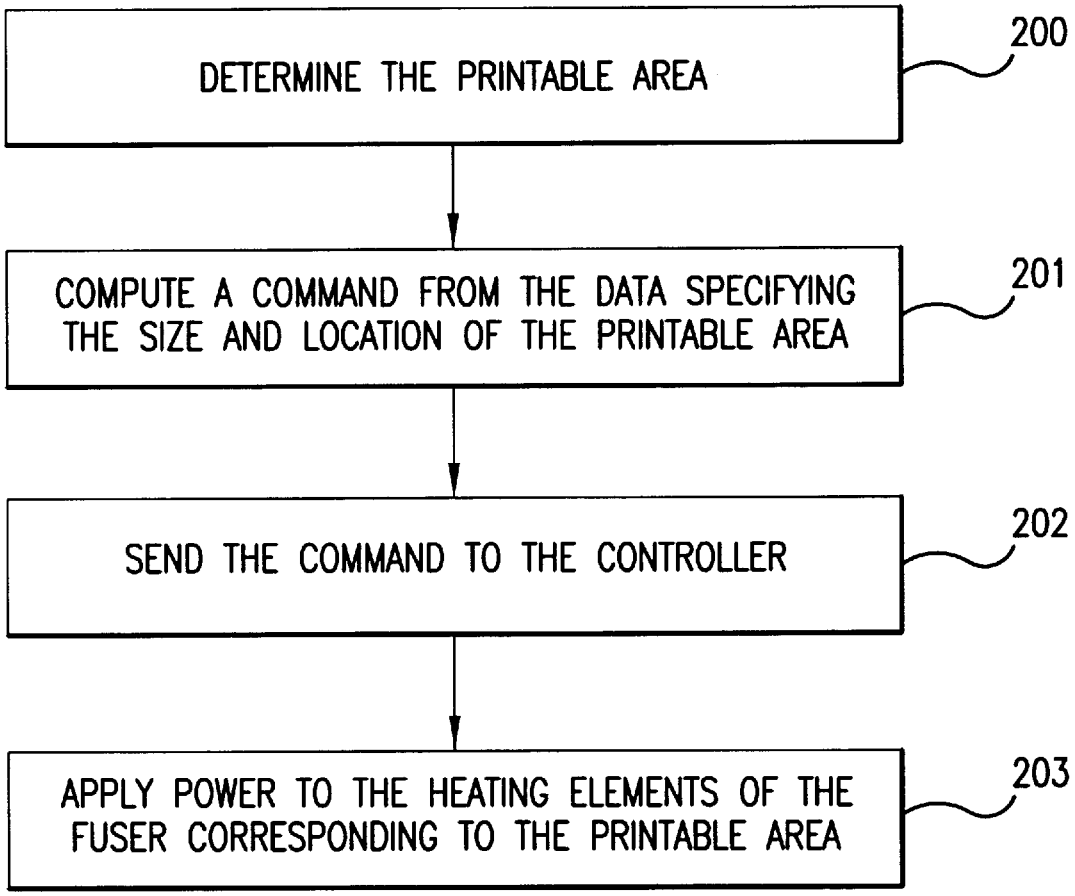
FIG. 3 shows a simplified flow chart of a second method for using the fixing device control system.

Shown in FIG. 3 is a high level flow chart of a method for using a second embodiment of the fixing device control system to control fuser 2 of electrophotographic printer 1. In the second embodiment of the fixing device control system, formatter 24 generates commands to send to controller 26 for energizing fuser 2 by computing them from the data defining the printing area. Additionally, in the second embodiment of the fixing device control system, firmware executed by a microprocessor performs the computation of the commands. First the microprocessor in formatter 24 determines 200 the printing area on print media 12 using the print data from host computer 25. Next, the microprocessor in formatter 24 computes 201 a command from the data specifying the size and location of the printing area. Then, formatter 24 sends 202 the command to controller 26. Finally, controller 26 applies 203 power to the heating elements of fuser 2 in order to obtain the desired temperature profile corresponding to the printing area defined by formatter 24.

Figure 4:
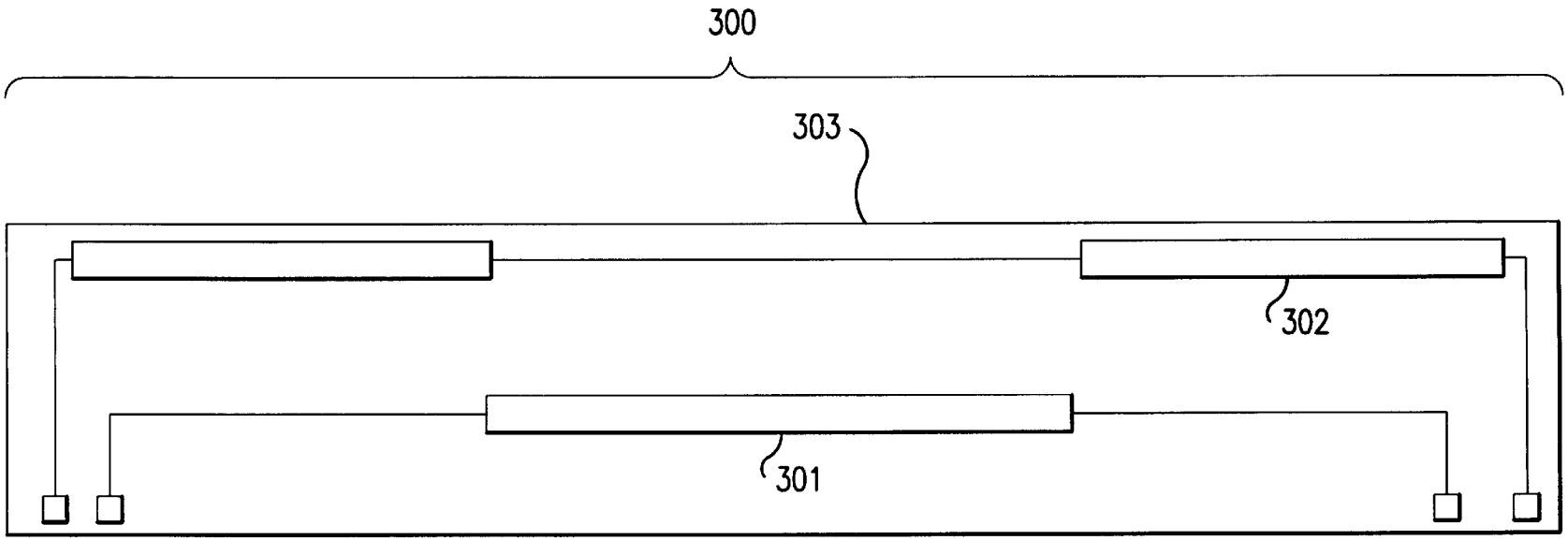
FIG. 4 shows part of a first instant on fuser which may be used with the fixing device control system.

Shown in FIG. 4 is a simplified representation of part of a first fuser 300 having two heating elements. The part of first fuser 300 shown in FIG. 4 could be used in the fixing device control system. Both first heating element 301 and second heating element 302 could be formed from a thick film deposition process onto ceramic substrate 303. First heating element 301 provides the fusing energy for print media passing over the central portion. Second heating element 302 includes two series connected segments located on opposite ends of the part of first fuser 300. Thermistors (not shown in FIG. 4) are used by the fixing device control system to monitor the temperature along the length of the part of first fuser 300. These temperature measurements are used by the fixing device control system to control the duty cycle of the power applied to first heating element 301 and second heating element 302 to achieve the optimal temperature profile corresponding to the printing area defined by formatter 24.

Figure 5:
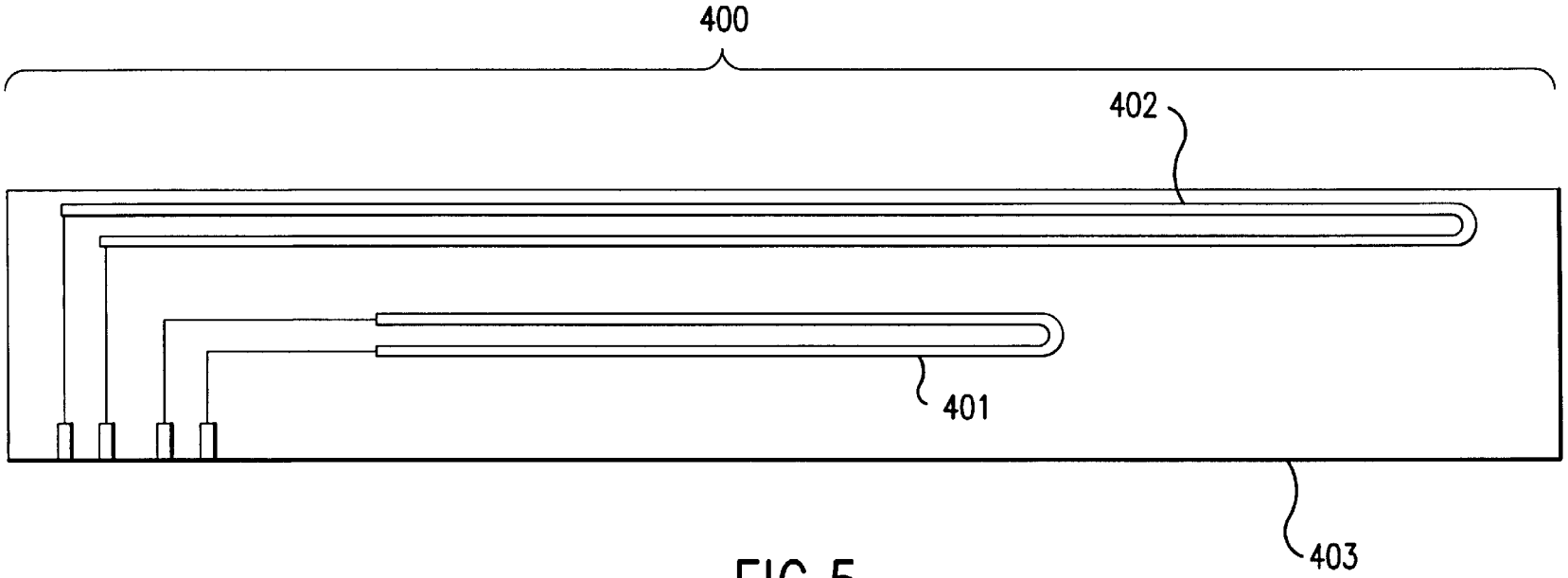
FIG. 5 shows part of a second instant on fuser which may be used with the fixing device control system.

Shown in FIG. 5 is a simplified representation of part of a second fuser 400 having two heating elements. The part of second fuser 400 shown in FIG. 5 could be used in the fixing device control system. Both first heating element 401 and second heating element 402 could be formed from a thick film deposition process onto ceramic substrate 403. First heating element 401 provides the fusing energy from print media passing over the central portion. Second heating element 402 spans the length of the part of second fuser 400 shown in FIG. 5 and is used for print media having a width greater than first heating element 401. The fixing device control system prevents the simultaneous application of power to first heating element 401 and second heating element 402. Thermistors (not shown in FIG. 5) are used by the fixing device control system to monitor the temperature along the length of part of first fuser 400. These measurements are used by the fixing device control system to control the duty cycle of the power applied to first heating element 401 and second heating element 402 to achieve the optimal temperature profile corresponding to the printing area defined by formatter 24.

Figure 6:
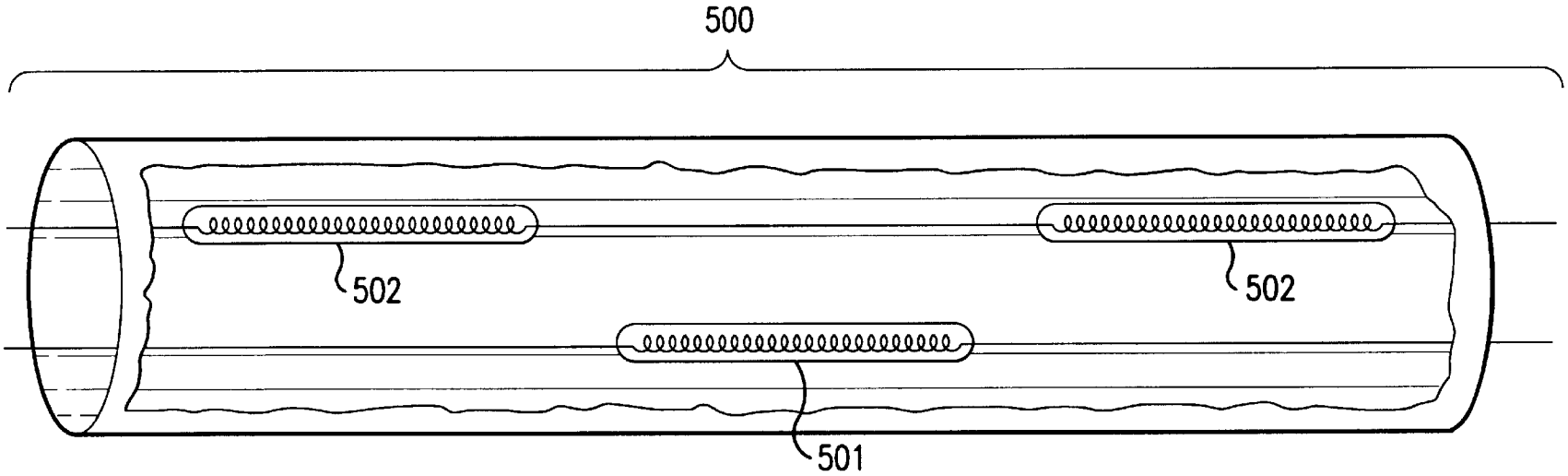
FIG. 6 shows part of a bulb fuser which may be used with the fixing device control system.

Shown in FIG. 6 is a simplified representation of part of a third fuser 500 having two heating elements. The type of fuser represented in FIG. 6 is a halogen bulb fuser. Halogen bulb fusers could be used in the fixing device control system. The part of the third fuser 500 includes a first heating element 501 and a second heating element 502. The spatial distribution of first heating element 501 and second heating element 502 permits control of the duty cycle of the power applied to first heating element 501 and second heating element 502 to achieve the optimal temperature profile corresponding to the printing area defined by formatter 24.

Although several embodiments of the invention have been illustrated, and their forms described, it is readily apparent to those of ordinary skill in the art that various modifications may be made therein without departing from the spirit of the invention or from the scope of the appended claims.

What is claimed is:

1. In an electrophotographic printing system for printing on print media, with the electrophotographic printing system including a fixing device having a plurality of heating elements, a method for controlling the application of power to the plurality of heating elements, comprising the steps of:

generating data from print data, with the data specifying a dimension of a printing area on the print media in a direction corresponding to a longitudinal axis of the fixing device;

generating a command from the data specifying to which of the plurality of heating elements to apply power; and controlling the application of power to the plurality of heating elements according to the command.

2. The method as recited in claim 1, wherein:

generating the command from the data includes computing the command from the data defining the printing area.

3. The method as recited in claim 1, wherein:

generating the command from the data includes accessing stored information, with the stored information relating the data defining the dimension of the printing area to the application of power to the plurality of heating elements.

4. The method as recited in claim 3, wherein:

the step of controlling the application of power includes applying power to the plurality of heating elements according to the stored information.

5. The method as recited in claim 4, wherein:

the fixing device includes a bulb fuser.

6. The method as recited in claim 4, wherein:

the fixing device includes an instant on fuser.

7. The method as recited in claim 6, wherein:

the plurality of heating elements includes a first heating element and a second heating element.

8. In an electrophotographic printing system, a system for controlling a fixing device having a plurality of heating elements, comprising:

a formatter to generate data from print data, with the data specifying a dimension of a printing area on print media in a direction corresponding to a longitudinal axis of the fixing device and with the formatter to generate a command from the data; and a controller operatively coupled to the formatter to receive the command, with the controller operatively coupled to the fixing device to control the application of power to the plurality of heating elements in response to the command.

9. The system for controlling the fixing device as recited in claim 8, wherein:

the formatter generates the command through computations using the data.

10. The system for controlling the fixing device as recited in claim 8, wherein:

the formatter generates the command from stored information accessed using the data.

11. The system for controlling the fixing device as recited in claim 10, wherein:

the fixing device includes a bulb fuser.

12. The system for controlling the fixing device as recited in claim 10, wherein:

the fixing device includes an instant on fuser.

13. The system for controlling the fixing device as recited in claim 12, wherein:

the plurality of heating elements includes a first heating element and a second heating element.

14. An electrophotographic printing system, comprising:

a fixing device having a plurality of heating elements;

a formatter to generate data from print data, with the data specifying a dimension of a printing area on print media in a direction corresponding to a longitudinal axis of the fixing device and with the formatter to generate a command from the data; and a controller operatively coupled to the formatter to receive the command and operatively coupled to the fixing device to control the application of power to the plurality of heating elements in response to the command.

15. The electrophotographic printing system as recited in claim 14, wherein:

the formatter generates the command through computations using the data.

16. The electrophotographic printing system as recited in claim 14, wherein:

the formatter generates the command from stored information accessed using the data.

17. The electrophotographic printing system as recited in claim 16, wherein:

the fixing device includes a bulb fuser.

18. The electrophotographic printing system as recited in claim 16, wherein:

the fixing device includes an instant on fuser.

19. The electrophotographic printing system as recited in claim 18, wherein:

the plurality of heating elements includes a first heating element and a second heating element.

* * * * *